US008973995B2

(12) United States Patent
Donati

(10) Patent No.: US 8,973,995 B2
(45) Date of Patent: Mar. 10, 2015

(54) DEVICE FOR SYNCHRONIZING THE TILT OF A CHAIR BACK AND SEAT

(75) Inventor: Armando Donati, Rodengo Saiano (IT)

(73) Assignee: Donati S.p.A., Rodengo Saiano (BS) (IT)

( * ) Notice: Subject to any disclaimer, the term of this patent is extended or adjusted under 35 U.S.C. 154(b) by 454 days.

(21) Appl. No.: 13/148,618

(22) PCT Filed: Feb. 25, 2009

(86) PCT No.: PCT/IT2009/000065

§ 371 (c)(1),
(2), (4) Date: Sep. 29, 2011

(87) PCT Pub. No.: WO2010/097818

PCT Pub. Date: Sep. 2, 2010

(65) Prior Publication Data

US 2012/0056461 A1 Mar. 8, 2012

(51) Int. Cl.
*A47C 1/032* (2006.01)

(52) U.S. Cl.
CPC ..... *A47C 1/03255* (2013.01); *A47C 1/03272* (2013.01)
USPC ..... 297/320; 297/300.5; 297/321

(58) Field of Classification Search
CPC ..... A47C 1/032; A47C 1/03255
USPC ..... 297/300.5, 316, 320, 321
See application file for complete search history.

(56) References Cited

U.S. PATENT DOCUMENTS

| | | | | |
|---|---|---|---|---|
| 5,251,958 | A | 10/1993 | Roericht et al. | |
| 6,959,965 | B2 * | 11/2005 | Diffrient | 297/320 X |
| 2004/0026973 | A1 * | 2/2004 | Sander et al. | 297/316 |
| 2004/0140702 | A1 * | 7/2004 | Daeschle et al. | 297/300.5 |

FOREIGN PATENT DOCUMENTS

| | | | |
|---|---|---|---|
| DE | 2026929 | A1 | 12/1970 |
| DE | 3735256 | A1 | 4/1989 |
| DE | 19607136 | A1 | 8/1996 |
| DE | 202005011725 | U1 | 12/2006 |
| DE | 202007001395 | U1 | 6/2008 |
| EP | 0540711 | B1 | 9/1996 |
| EP | 1256294 | A | 11/2002 |
| EP | 1440632 | A | 7/2004 |
| WO | WO 0074531 | | 12/2000 |
| WO | WO 2008149224 | A1 | 12/2008 |

OTHER PUBLICATIONS

International Search Report of PCT/IT2009/000065 dated Dec. 4, 2009.

(Continued)

*Primary Examiner* — Anthony D Barfield
(74) *Attorney, Agent, or Firm* — Lucas & Mercanti, LLP

(57) ABSTRACT

Device for synchronizing the tilt of a chair back and seat, of the type comprising a frame of the chair back (5), a frame of the seat (2) and a support (1) integral with the base of the chair, as well as at least one first crank (3), integral with the afore said frame of the chair back (5), and hinged (6, 7) at the rear to the frame of the seat (2) and to the support (1), and at least one second crank (4), hinged (8, 9) at the front to the frame of the seat (2) and to the support (1). The afore said first crank (3) and the second crank (4), with the frame of the seat (2), determine a articulated quadrilateral, wherein such a first crank (3) and such a second crank (4) lie substantially on skew lines.

11 Claims, 3 Drawing Sheets

(56) References Cited

OTHER PUBLICATIONS

Communication of a Notice of Opposition, Application No. 09787650.2-1656.

Substantiation of Opposition Against EP 2375938B1, dated Jun. 18, 2013.

Introduction to Vector Analysis, Cambridge University Press, p. 147.

* cited by examiner

DEVICE FOR SYNCHRONIZING THE TILT OF A CHAIR BACK AND SEAT

CROSS-REFERENCE TO RELATED APPLICATIONS

This application is a 371 PCT/IT2009/000065 filed on Feb. 25, 2009, the contents of which are incorporated herein by reference.

FIELD OF THE INVENTION

The present invention concerns to a device for synchronizing the tilt of the back and seat of a chair, of the type wherein the tilt angle assumed by the seat frame relatively to the horizontal line is correlated to the tilt angle assumed by the corresponding frame of the chair back thanks to a kinematic system with articulated rods, such that the user, thanks to his/her own weight and to his/her rest on the chair back, could find a convenient tilt adjustment of such frames relatively to the ground, simply sitting on the chair.

BACKGROUND ART

It is known art realizing such a type of synchronizing device, defined in the art as "personal-weighing", by hinging the seat frame to a support integral with the chair base by two cranks, usually reciprocally parallel, conveniently shaped and hinged to the afore said support, such that their rotation cause a corresponding rotation of the seat frame relatively to the ground. The crank rotation may be caused indirectly by the frame rotation of the chair back, constrained to one of the cranks, or to the seat frame, by an articulated system.

For example, the International Patent Application WO-A-2008/149224 in the name of MALENOTTI, describes such a device, wherein the frame of the chair back is constrained to the seat frame by a leverage causing the roto-translation on such a seat frame, when the user causes the rotation of the frame of the chair back itself. The shape of the four-bar linkage constraining the seat frame to the support integral with the base is of the type allowing such a roto-translation, leading the seat from a starting position, substantially horizontal, with the chair back erected, to a final position, with the chair back reclined at the rear, wherein the seat is withdrawn towards the chair back and its front portion is lifted, even if to few degrees, relatively to its rear portion.

Such a MALENOTTI device, while allowing an efficient synchronization of the chair back tilt with the seat tilt, is mechanically complex and then markedly burdensome to manufacture.

In addition, the device described in the Application WO-A-2008/149224 does not allow obtaining, during the device designing and producing steps, desired changes in the initial or final tilt angle of the seat simply, because of the multitude of components that would be newly designed and replaced.

Alternatively to such a device, it is known to realize a seat wherein the seat tilt, while the chair back tilt is varying, is controlled by a lever with two arms, wherein one arm is integral with the frame of the chair back, one arm is acting on the rear end of the seat frame, and the whole lever has a fulcrum on the afore said support integral with the seat base.

Such a solution, wherein the front portion of the seat frame is constrained to the base support by a rod hinged to the same support and integral with such a front portion of the seat frame, is described in the French Application FR-A-2045120 in the name of DUPART.

The DUPART device, although extremely simple, provides that while the tilt angle of the chair back is increasing, relatively to its rest position, the rear portion of the seat would raise relatively to the corresponding front portion, with a certain worsening of the posture achievable by the user, when the latter would like to lean against the chair back.

It is therefore an object of the present invention to realize a device for synchronizing the tilt of a back and seat of a chair of the type wherein while the tilt angle of the chair back is increasing, the corresponding raising of the front portion of the seat is occurring relatively to the rear portion, that would not produce the known art drawbacks and thereby being structurally simple and easy and efficient to set up. Another object of the present invention is to provide a device, easily adjustable in the designing step, that would not be expensive to manufacture and at the same time allowing the user to find a correct posture relating to his/her own weight.

SUMMARY OF THE INVENTION

These and other objects are obtained by the device for synchronizing the tilt of a chair back and seat according to the first independent claim and the subsequent dependent claims.

According to the present invention, the device for synchronizing the tilt of a chair back and seat is of the type wherein while the tilt angle of the chair back is increasing relatively to its unloaded position, the raising of the front portion of the seat is occurring relatively to the corresponding rear portion, and comprises a frame of the chair back, a frame of the seat and a support integral with the base of the chair, as well as at least one first crank, integral with the frame of the chair back, and hinged at the rear to the frame of the seat and to the support integral to the base, and at least one second crank, hinged at the front to the frame of the seat and to the support itself. Such a first crank and such a second crank, with the afore said frame of the seat, constitute an articulated quadrilateral, wherein the first and the second crank lie substantially on two reciprocally skew lines.

Such a solution, of which the geometrical parameters (for example and preferably the crank lengths and/or the tilt angle relatively to the latter and/or the elevation of their hinge point to the base support relatively to the ground) necessary to allow the raising of front portion of the seat relatively to the corresponding rear portion while tilting the chair back, are easily inferred from an elementary kinematic analysis of the structure, proved to be structurally simple and practical to realize, as well as allowing the user to easily obtain the correct posture, at least partially, according to his/her weight.

In addition, according to a preferred aspect of the present invention, the seat frame, or anyway the seat, is movable between an initial position, preferably horizontal, corresponding to the lowest tilt of the frame of the chair back, and a final position, corresponding to the highest tilt of the frame of the chair back, and the afore said articulated quadrilateral is shaped such that when the seat frame, or the seat, is in its final position, the hinge point of the second crank to the frame of the seat will vertically raise of a higher amount relatively to the hinge point of the first crank to the frame of the seat and such that the hinge point of the second crank to the frame of the seat will assume a higher elevation relatively to the elevation of the hinge point of the first crank to the seat frame, such that the seat will be raised in its front portion more than in its rear portion.

Preferably, according to such an aspect of the present invention, the seat frame is tilted, relatively to the horizontal line, of an angle comprised between 4° and 8°, when the afore said seat frame is in its final position.

According to another aspect of the present invention, the afore said second crank is tilted relatively to the horizontal line of an angle always lower than the tilt angle of the first crank, and the afore said first crank has a lower length than the afore said second crank, such that to easily allow the raising of the front portion of the seat, when the chair back tilt is increasing, towards the rear portion of the chair.

BRIEF DESCRIPTION OF THE DRAWINGS

For purposes of illustrations and not limitative a preferred embodiment of the present invention will be described with reference to the accompanying drawings, in which.

DETAILED DESCRIPTION OF A PREFERRED EMBODIMENT OF THE PRESENT INVENTION

Figure 1:
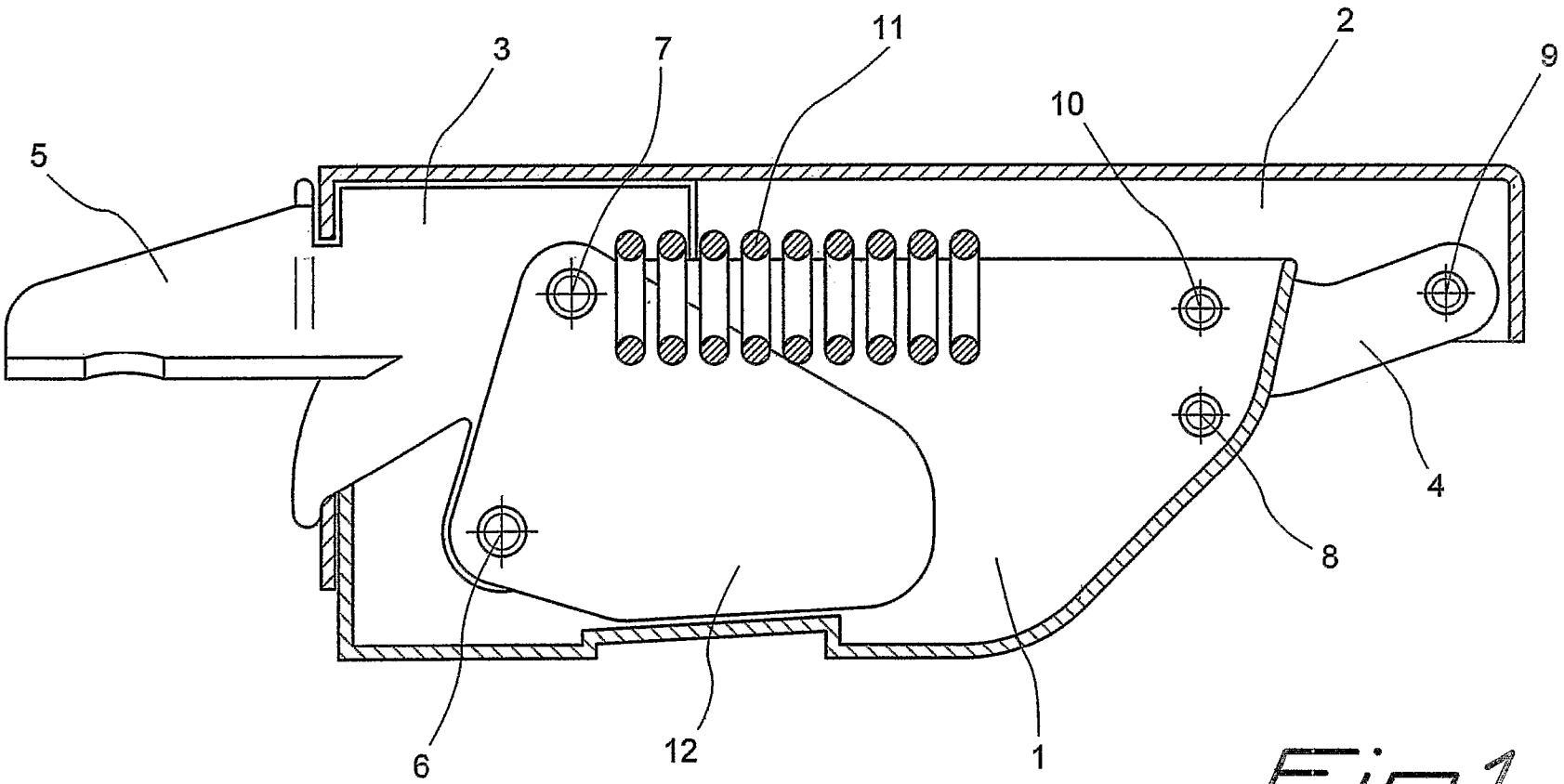
FIG. 1 is a schematic side section view of a device according to the present invention, illustrated with the frame of the chair back and the frame of the seat in their unloaded initial position.
Figure 2:
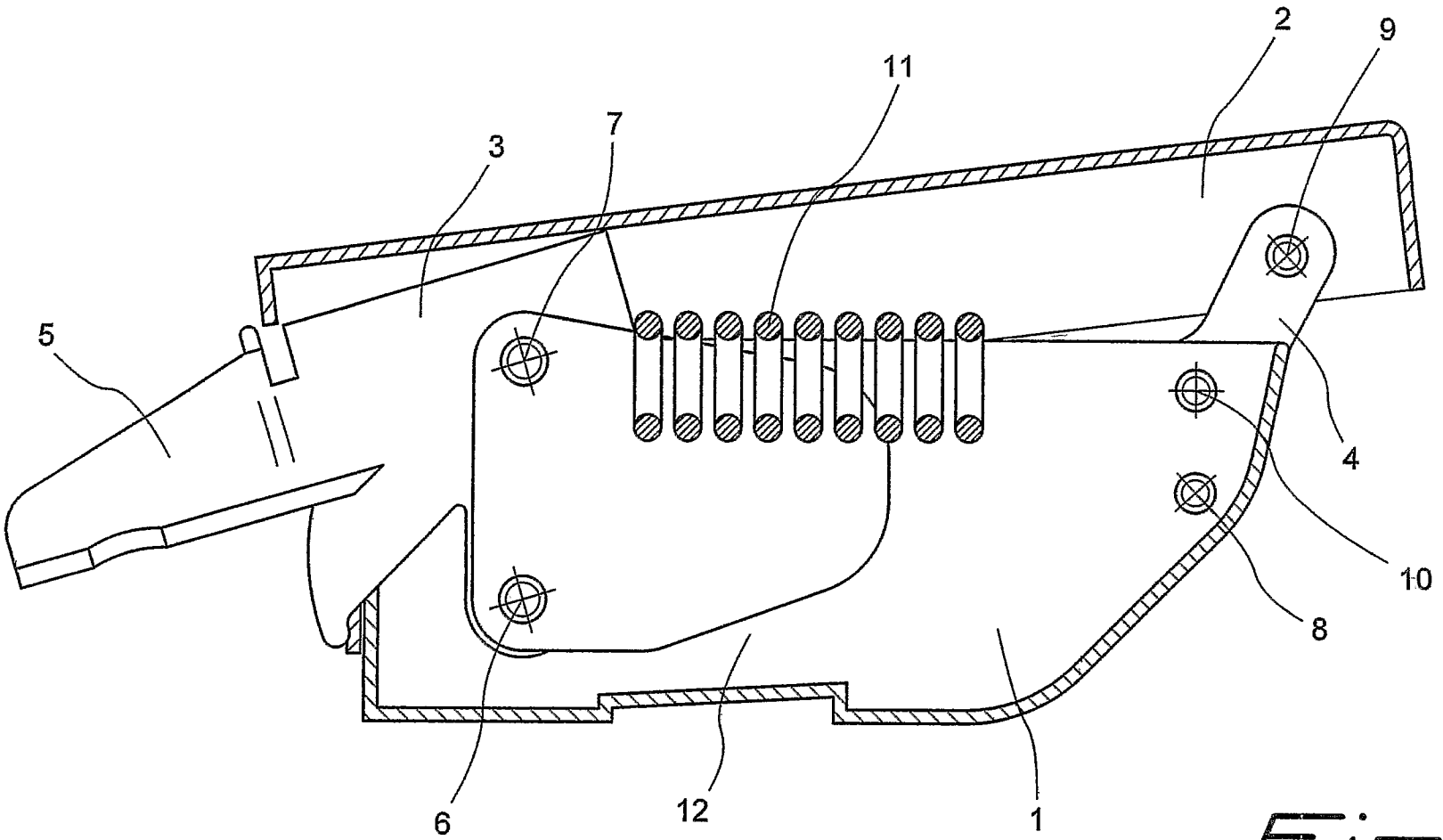
FIG. 2 is a schematic side section view of the device shown in FIG. 1, caught with the frame of the chair back and the frame of the seat in their final position of highest tilt of the chair back.

Referring to FIGS. 1 and 2 in the whole, the device for synchronizing the tilt of a chair back and seat, according to the present invention, comprises a support 1 integral with the chair base, a frame of the seat 2, constrained to the support 1 by at least one first rear crank 3, and at least one second front crank 4, as well as a frame of the chair back 5 (only the lower portion thereof being visible in the figures), integrally constrained with the rear crank 3.

It has to be observed that, herein and afterwards, with the term "crank" is intended such a swivel body, having ideally a rod shape, interconnecting a fixed pin to a mobile pin, in an articulated system.

The two cranks 3 and 4, the frame of the seat 2, and the corresponding pins 6, 7, 8, 9, constitute an articulated quadrilateral, as can be seen in the figures.

It has to be also noticed that, according to the crank definition afore mentioned, the so far described cranks 3, 4 could actually be rocker levers in the articulated quadrilateral defined by the frame of the seat 2 and the afore said support 1 too, while the frame of the seat 2 constitutes the rod of such a articulated quadrilateral. More particularly, the first (rear) crank 3 is constrained to the support 1 thanks to a fixed pin 6, and it is constrained in the rear portion of the frame of the seat 2 thanks to a pin 7.

Similarly, the second (front) crank 6 is constrained to the support by a pin 8 and it is constrained to the front portion of the frame of the seat 2, by a pin 9. It has to be observed that with the terms "front" and "rear" are intended such regions of the seat frame respectively the most distant from, and the nearest to, the frame of the chair back 5.

More in detail, the frame of the chair back 5, in the embodiment herein illustrated, is realized in a single piece with the corresponding rear crank 3, such that a portion of the frame of the chair back 5 itself, hinged to the pin 6, fixed to the support 1 of the chair, and to the pin 7, fixed to the frame of the seat 2, thereby will constitute such a crank 3.

The synchronization device herein illustrated further comprises elastic means 11, adapted to apply a returning action for the frame of the chair back 5, and/or for the frame of the seat 2, towards the support 1.

According to a preferred aspect of the present invention, such an elastic means comprise a helical spring 11, acting in compression, constrained to an appropriate pin 10, integral with the support 1, and to the pin 7 integral with the frame of the seat 2. Therefore the spring 11 tends to draw up the pins 7 and 10, exercising a returning force acting on the frame of the seat 2 towards the support 1. The spring 11, the resistance thereof must so be won to allow the tilting of the chair back and of the seat of the chair provided with the device herein illustrated, will then determine an initial position of the device, wherein the frame of the chair back 5 is in its position of lowest tilt relatively to the horizontal line, because the returning action of the spring 11 is exercised to the crank 3 too, that is just integral with the frame of the chair back 5.

Finally, the FIGS. 1 and 2 further show a plate 12 constrained to the crank 3, and then to the frame of the chair back 5, by the afore said pins 6 and 7. Such a plate 12 has the function of acting as a rabbet element for the apposite stopping retainers, obtained over appropriate zones of the support 1 of the chair, so that to define the stop points for the swing of the frame of the chair back 5 and the frame of the seat 2. Advantageously, the first and the second crank 3 and 4, or better the axes connecting in such cranks 3, 4 respectively the corresponding hinging points, lie over reciprocally skew lines, that is their relative tilt angle is not null.

It means that, if lengths and tilt angles of such rear and front cranks 3, 4 are conveniently chosen, the different tilt of the latter will determine two different laws of motion of the hinge points 7, 9 of the same cranks 3, 4 to the frame of the seat 2, while the cranks 3, 4 are rotating. Such laws of motion, as will be evident for a person skilled in the art, may allow the raising or the lowering of the front portion of the frame itself of the seat 2 relatively to its rear portion during the motion of the cranks 3, 4 themselves.

It has to be noticed that, as mentioned yet, here and afterwards with the term "crank" is not properly intended the real body, in its whole, that is used in the device of the present invention to connect the support integral to the chair base to the seat frame, but it is intended the ideal portion of such a body acting as a crank in a articulated quadrilateral composed exactly by the two cranks 3, 4 and the frame of the seat 2. That is, in the device of the present invention, with the term crank is herein intended such a body, or body portion, ideally having a rod shape, that is hinged to the support 1 integral to the base fixed to the chair and to the movable frame of the seat 2, freely to rotate around such pins 6, 7. As described yet, such a crank 3 is, in the particular embodiment of the present invention herein illustrated, obtained as a whole with the frame of the chair back 5.

It has further to be observed that, also if it has been so far described a synchronizing device having only two cranks 3, 4, it is further possible to realize a similar synchronizing device, according to the present invention, having more parallel cranks, without therefore falling out from the treatise so far followed. For example, each crank 3, 4 of the device represented in the figures may be matched to a corresponding crank parallel to this, adapted to allow a better distribution of the load, acting over the frame of the seat 2, that discharges on the support 1 of the chair. According to a preferred aspect of the present invention, the hinge points 6, 8 of the cranks 3, 4 to the support 1 integral with the chair base, the lengths of such cranks 3, 4, that is the distance between the two hinge points of each crank, and the relative tilt angle between the two cranks 3, 4, that is the ratio between the tilt angles of every crank 3, 4 relative to the horizontal line, may be selected such that the frame of the seat 2 could be movable between an initial position, for example wherein the seat or the corresponding frame 2 is substantially horizontal, and the frame of the chair back 5 is in its lowest tilt position relatively to the horizontal line, and a final position, wherein the seat, or the corresponding frame 2, is raised mostly in its front portion relatively to the corresponding rear portion, that is the front portion exhibits a vertical component movement higher than that in the rear portion, and the frame of the chair back 5 has reached its highest tilt relatively to the horizontal line, eventually determined by stopping retainers for the tilt of such a frame 5, not shown.

Figure 3:
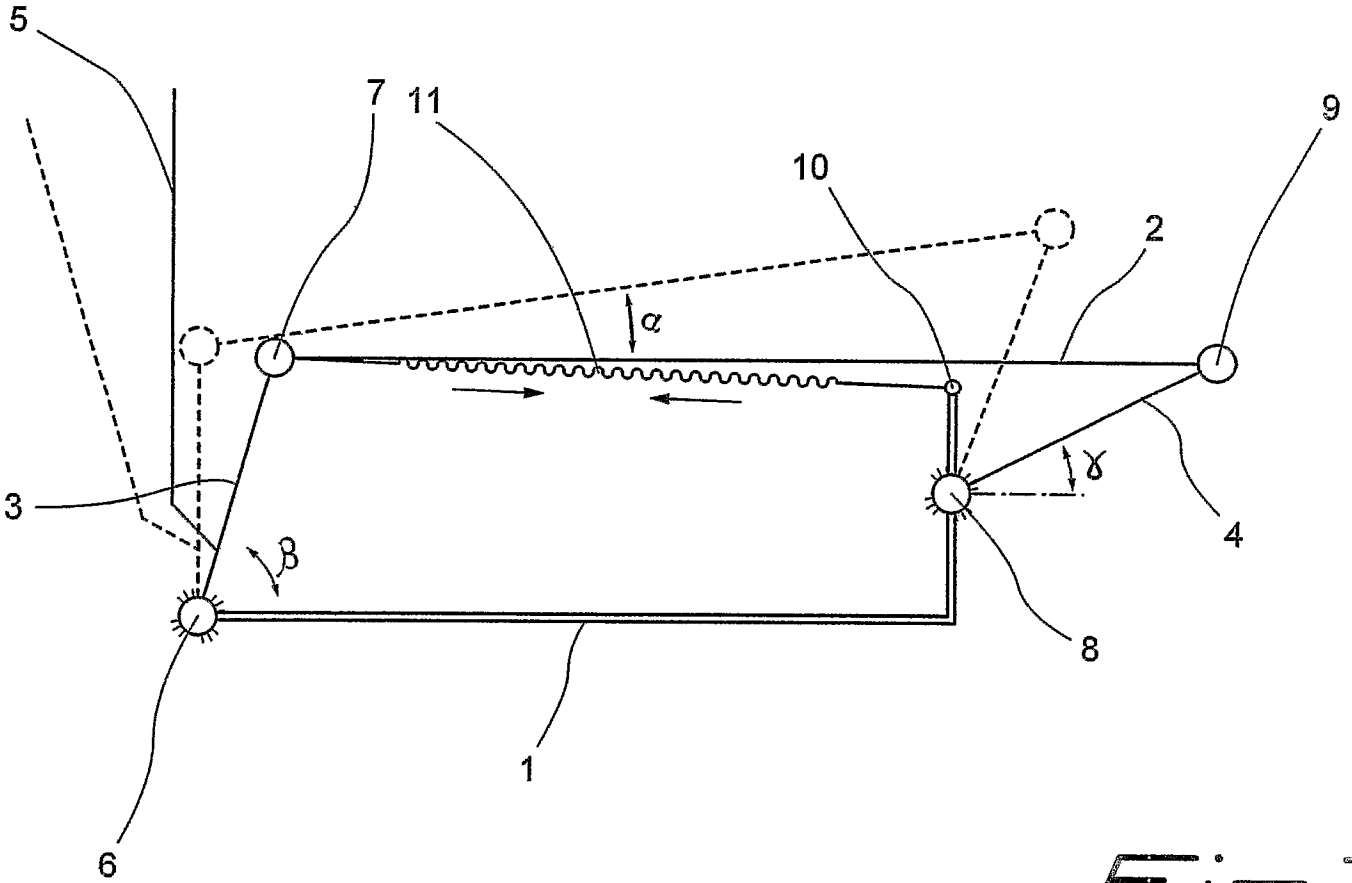
FIG. 3 is a kinematic scheme showing the device operation according to the present invention.

Referring to FIG. 3 too, this solution, according to a particular aspect of the present invention, could be realized using a rear crank 3 having different dimensions from the front crank 4, and setting the corresponding hinge points shifted on the support 1, as well as imposing the angle $\gamma$ formed by the front crank 4 relatively to the horizontal line to be always lower than the angle $\beta$ determined by the rear crank 3 relatively to the horizontal line.

Further, according to a characteristic aspect of the present invention, such an angle $\beta$ between the rear crank 3 and the horizontal line may change between a value chosen in the range 55°-75°, when the frame of the seat 2 is in its mentioned initial position, and 90°, when the frame of the seat 2 is in its final position.

Further, according to another aspect of the present invention, preferably in case wherein the frame of the seat 2 is perfectly parallel to the seat, the device may be shaped such that the hinge point 9 of the front crank 4 to the frame of the seat 2 is substantially at the same elevation of the elevation of the hinge point 7 of the rear crank 3 to the frame of the seat 2, when the latter is in its afore said initial position, and such that it is at a higher elevation than the elevation of the hinge point 7, when the afore said frame of the seat 2 is in its final position.

Preferably, it is possible to force the angle $\alpha$, that the frame of the seat 2 makes relatively to the horizontal line, is comprised between 4° and 8°, and hence the front portion of the seat could be at a higher elevation than the elevation of the corresponding rear portion, such that the seat tilt is substantially comprised between 4° and 8° to the horizontal line.

Indeed, such values proved to be optimal for a correct posture the user may assume on the chair, when the latter is provided with the device according the present invention.

Now particularly referring to FIG. 3, showing the kinematic scheme of the synchronizing device illustrated in FIGS. 1 and 2, respectively in its initial and final position (dotted line), the operation of such a device will be now described.

It will be assumed that the frame of the seat 2 is parallel to the user seat, such that the tilt angle of such a frame 2 will match with the seat tilt angle, and likewise the frame of the chair back 5 will be parallel to the chair back.

When the chair is not loaded, that is when the user is not seated, the synchronizing device of the present invention is maintained in its initial position by the spring 11 that, acting on the pin 7, movable together with the frame of the seat 2, and on the pin 10, fixed on the support 1, will tend to rotate the rear crank 3 around the pin 6, until it will reach the initial tilt predefined angle $\beta$, preferably comprised between 55° and 75°.

In this initial position, the articulated quadrilateral formed by the two cranks 3, 4 and the frame of the seat 2 is shaped such that the frame of the seat 2 is substantially horizontal and the frame of the chair back 5 is substantially vertical, in its lowest tilt position.

When the user will seat on the chair provided with the synchronizing device herein illustrated, and then will apply a load on the chair back able to win the resistance of the spring 11, the consequent rotation of the frame of the chair back 5 around the pin 6 will cause the identical rotation of the rear crank 3 around such a pin 6, and then the rotation of the front crank 4 around its own pin 8, as well as the rotation of the frame of the seat 2 around a swing center situated over the same frame 2, and such to determine the raising of the front portion of the seat relatively to the corresponding rear portion.

Such rotations, in the final determining a continuous changing of the angle $\alpha$ formed by the frame of the seat 2 relatively to the horizontal line in function of the tilt reached by the frame of the chair back 5, will cause the raising of both pins 7 and 9, which obviously rotate around the corresponding pins 6 and 8, thanks to the cranks 3, 4, of an extent different in function of the covered angle and the length of the corresponding crank 3, 4, and anyway such that the vertical component of such a movement of the pins 7 and 9 is higher in the front pin 9 and lower in the rear pin 7, such that the afore said raising of the front portion of the seat relatively to the rear portion is observed.

It has to be noticed that the tilt of the frame of the seat 2 and the frame of the chair back 5 are, at least partially, function of the user weight, because such a weight partially determines both the force the user is applying on the chair back, and the resistance offered by the frame of the seat 2 against its rotation; the resistance being caused not only by the force applied by the spring 11, but also by the user weight on the seat itself.

Then the highest tilt angle $\alpha$ the frame of the seat 2 can reach relatively to the horizontal line is determined by the highest tilt angle the frame of the chair back 5 can reach, in the afore said final position obtained by the frame of the seat 2, thanks to the applied user load, and such an angle $\alpha$ may be preferably comprised between 4° and 8° relatively to the horizontal line, to always guarantee an optimal posture for the user himself.

The highest tilt angle of the frame of the chair back 5, as mentioned, may be determined by the stopping retainers acting conveniently on the rear crank 3, or the frame 5 itself, and it cannot exceed the angle corresponding to the tilt angle $\beta$ of the rear crank 3 substantially equal to 90° relatively to the horizontal line, beyond which the crank 3 may again rotate, causing jams in the device itself.

As before described, when the user will end using the chair, the spring 11 will return the several components of the synchronizing device in the afore said initial position, particularly inducing the rear crank 3 rotation, adapted to bring back the seat 2 in its initial position, substantially horizontal.

As the Applicant founded in practice, the device of the present invention is simply to realize by the producer, handy to adjust for the designer and simply and efficient for the final user usage.

The invention claimed is:

1. Device for synchronizing the tilt of a chair back and seat, of the type comprising a frame of the chair back, a frame of the seat and a support integral with the base of said chair, as well as at least one first crank, integral with said frame of the chair back, and hinged at the rear to said frame of the seat and to said support, and at least one second crank, hinged at the front to said frame of the seat and to said support, said at least one first crank and said at least one second crank, with said frame of the seat, determining an articulated quadrilateral, wherein said at least one first crank and said at least one second crank lie substantially on skew lines, wherein both the hinge point of said at least one second crank to the frame of the seat and the hinge point of said at least first crank to said frame of the seat raise during rotation of the frame of the seat from said initial position to said final position whereby said frame of the seat moves towards said frame of the chair back, and wherein said frame of the seat is movable between an initial position, corresponding to the lowest tilt of said frame of the chair back, and a final position, corresponding to the highest tilt of said frame of the chair back, the hinge point of said at least one second crank to the frame of seat being substantially at the same elevation as the elevation of the hinge point of said at least one first crank to the frame of the seat, when said frame of the seat is in its initial position, and the hinge point of said at least one second crank being at a higher elevation relative to the elevation of the hinge point of said at least one first crank to the frame of the seat, when said frame of the seat is in its final position, and wherein said at least one first crank and said at least one second crank are a swivel body interconnecting a fixed pin to a movable pin.

2. Device according to claim 1, wherein said frame of the seat is movable between an initial position, corresponding to the lowest tilt of said frame of the chair back, and a final position, corresponding to the highest tilt of said frame of the chair back, the hinge point of said at least one second crank to the frame of the seat, or the front portion of the seat, vertically raising of a higher amount relatively to the hinge point of said at least one first crank to said frame of the seat, or relatively to the rear portion of the seat, when said frame of the seat is in its final position.

3. Device according to claim 2, wherein said frame of the seat, or said seat, is tilted relatively to the horizontal line of an angle ($\alpha$) comprised between 4° and 8°, when said frame of the seat is in its final position.

4. Device according to claim 2, wherein said at least one first crank, when said frame of the seat is in its final position, is tilted relatively to the horizontal line of an angle ($\beta$) substantially equal to 90°.

5. Device according to claim 2, wherein said at least one first crank, when said frame of the seat is in its initial position, is tilted relatively to the horizontal line of an angle ($\beta$) comprised between 55° and 75°.

6. Device according to claim 1, wherein said at least one second crank is tilted relatively to the horizontal line of an angle ($\gamma$) always lower than the tilt angle ($\beta$) of said at least one first crank.

7. Device according to claim 1, wherein said at least one first crank has a lower length that said at least one second crank.

8. Device according to claim 1, further comprising elastic returning means for said frame of the chair back or said frame of the seat relatively to said support integral with the chair base.

9. Device according to claim 8, wherein said elastic returning means comprise at least one spring hinged to said support and to the hinge point of said first crank to said frame of the seat.

10. Device according to claim 1, wherein said second crank is tilted relatively to the horizontal line of an angle always lower than the tilt angle of said first crank, and said first crank has a lower length than the said second crank, to allow raising of the front portion of the seat, when the chair back tilt is increasing, towards the rear portion of the chair.

11. Device according to claim 1, wherein each of the first and second crank are matched to a corresponding parallel crank.

* * * * *